US007954681B2

(12) United States Patent
Smith et al.

(10) Patent No.: US 7,954,681 B2
(45) Date of Patent: Jun. 7, 2011

(54) SINGLE TOOL NAILING BRIDGE SYSTEM

(75) Inventors: Aubrey Smith, Cordova, TN (US); Stephen Fleming, Southaven, MS (US); Robert Tucker, Memphis, TN (US); Douglas Dodd, Hernando, MS (US)

(73) Assignee: Illinois Tool Works Inc., Glenview, IL (US)

( * ) Notice: Subject to any disclaimer, the term of this patent is extended or adjusted under 35 U.S.C. 154(b) by 137 days.

(21) Appl. No.: 12/285,153

(22) Filed: Sep. 30, 2008

(65) Prior Publication Data

US 2009/0127311 A1 May 21, 2009

Related U.S. Application Data

(60) Provisional application No. 60/960,529, filed on Oct. 2, 2007.

(51) Int. Cl.
*B21J 15/10* (2006.01)

(52) U.S. Cl. ..... 227/111; 227/107; 227/143; 227/144; 227/145; 91/525; 92/12.1; 408/87; 408/88; 408/234; 408/236; 804/238; 804/91

(58) Field of Classification Search ..... 227/111, 227/107, 143–145; 91/525; 92/12.1; 408/87–88, 408/234, 236, 238, 91
See application file for complete search history.

(56) References Cited

U.S. PATENT DOCUMENTS 4,373,920 A * 2/1983 Hall et al. ..... 440/59
4,397,590 A * 8/1983 Friesen et al. ..... 405/271
4,505,187 A * 3/1985 Burgio di Aragona ..... 92/31
4,557,696 A 12/1985 Nakahama
5,154,643 A * 10/1992 Catania et al. ..... 29/34 B
5,248,074 A * 9/1993 Speller et al. ..... 227/51
5,307,974 A * 5/1994 Chitty et al. ..... 227/1
5,381,597 A 1/1995 Petrove
5,661,892 A * 9/1997 Catania et al. ..... 29/525.02
6,220,494 B1 * 4/2001 Raffoni ..... 227/2
6,223,413 B1 * 5/2001 Crocker et al. ..... 29/524.1
6,378,197 B1 4/2002 Hansen
6,926,094 B2 * 8/2005 Arntson et al. ..... 173/32
7,010,851 B2 * 3/2006 Cassese et al. ..... 29/714
7,162,948 B2 * 1/2007 Sanderson et al. ..... 92/12.2
2004/0089695 A1 * 5/2004 Svensson ..... 227/99
2004/0089696 A1 * 5/2004 Alvarsson ..... 227/107
2004/0151556 A1 * 8/2004 Ferrari et al. ..... 409/201

* cited by examiner

*Primary Examiner* — Rinaldi I. Rada
*Assistant Examiner* — Michelle Lopez
(74) *Attorney, Agent, or Firm* — Law Offices of Steven W. Weinrieb

(57) ABSTRACT

A new and improved nailing bridge system which comprises a single nailing gun which is mounted for movement along a stud frame locus or a seam locus, defined by means of abutting sheets of wall sheathing, covering, paneling, or the like, wherein the single nailing gun can be moved to any one of effectively an infinite number of positions so as to permit nails to be driven into the covering, sheathing, paneling, or the like, in order to fixedly secure the sheathing, covering, paneling, or the like, to underlying stud frame members of a wall structure or wall panel member. Stitcher guns are also mounted upon a separate support beam so as to fixedly secure the sheathing, covering, paneling, or the like, to the upper and lower plate, header, or footer members of the wall structure or wall panel member.

19 Claims, 3 Drawing Sheets

SINGLE TOOL NAILING BRIDGE SYSTEM

CROSS-REFERENCE TO RELATED PATENT APPLICATIONS

This patent application is related to, based upon, and effectively a utility patent application conversion of U.S. Provisional Patent Application Ser. No. 60/960,529 which was filed on Oct. 2, 2007, the date benefits of which are hereby claimed.

FIELD OF THE INVENTION

The present invention relates generally to assembly apparatus, and more particularly to a new and improved nailing bridge system which is effectively defined by means of a framework which is movable along tracks fixedly secured to the floor of the fabrication plant or facility. The nailing bridge system comprises a single nailing gun which is mounted for movement upon a carriage along a first support beam which runs parallel to a stud frame locus or which runs parallel to a stud seam locus, defined by means of abutting sheets of wall sheathing, covering, paneling, or the like, disposed over or meeting together upon a particular stud frame locus or seam locus, wherein the single nailing gun can be moved to any one of effectively an infinite number of positions so as to permit nails to be driven into the covering, sheathing, paneling, or the like, in order to fixedly secure the sheathing, covering, paneling, or the like, to the underlying stud frame members of a wall structure or wall panel member. Stitcher guns are also mounted upon a separate support beam so as to fixedly secure the sheathing, covering, paneling, or the like, to the upper and lower plate, header, or footer members of the wall structure or wall panel member.

The entire nailing gun and stitcher gun assemblies are also supported upon lifter mechanisms which include the support beams which are vertically adjustable so as to adjust the positions of the nailing gun and the stitcher guns with respect to the underlying framework comprising the upper and lower plate, header, or footer members, and the stud members, of the wall structure or wall panel member, so as to properly position the nailing gun and the stitcher guns with respect to the underlying framework. The nailing gun is mounted upon the carriage which is also vertically adjustable with respect to the underlying framework, and the nailing gun can also be positively or negatively tilted so as insert nails at a predetermined angular orientation with respect to the aforenoted seams so as to enhance pull-out resistance as well as to effectively ensure that the nails are entered properly into the stud members and do not protrude outside the stud members. All movements of the various moving components are under the control of a programmable logic controller (PLC) in accordance with information fed to it by means of a pair of rotary encoders operatively associated with the motor drive for the carriage assembly supporting the nailing gun or the motor drive for moving the entire framework along the floor-mounted tracks of the plant or facility.

BACKGROUND OF THE INVENTION

In connection with the fixation of sheathing, covering, paneling, or the like, to underlying wall panel frameworks, formed, for example, by means of a plurality of stud frame members, and upper and lower plate, header, or footer members fixedly secured to the stud frame members, conventional apparatus employs, for example, a multiplicity of nailing guns, such as, for example, as many as two dozen nailing guns, which are arranged within a linear array so as to simultaneously drive nails into the sheathing, covering, paneling, or the like, in order to fixedly secure the same to the underlying wall panel framework. As can therefore be readily appreciated, the cost of such a system is substantial in that the same entails the purchase and maintenance of the multiplicity of nailing guns. In addition, while the guns are movably adjustable upon the nailing bridge or support beam, each gun must nevertheless be fixed by operator personnel at a predetermined position upon the nailing bridge or support beam so as to in fact enable the nails to be driven into the sheathing, covering, paneling, or the like, and the underlying wall panel framework, at desired locations of the entire wall panel or wall structure. Such a process is both tedious and time-consuming. In addition, in view of the fact that a multiplicity of nailing guns are being employed, the aforenoted positional adjustments can only be implemented within predetermined spatial ranges in order that the nails are in fact driven or inserted into the sheathing, covering, paneling, or the like, and the underlying wall panel framework, in accordance with predetermined patterns or arrays which are often dictated by means of various building codes.

A need therefore exists in the art for a new and improved nailing bridge wherein a single nailing gun can be movably disposed upon the nailing bridge so as to rapidly perform nailing operations along loci defined by means of stud frame members, or along loci defined by means of abutting sheets of wall sheathing, covering, paneling, or the like, in order to fixedly secure the covering, sheathing, paneling, or the like, to the underlying wall panel framework.

SUMMARY OF THE INVENTION

The foregoing and other objectives are achieved in accordance with the teachings and principles of the present invention through the provision of a new and improved nailing bridge assembly which comprises a support beam upon which a carriage is movably supported. A nailing gun is mounted upon the carriage, and the support beam is mounted upon a framework which is movable along tracks affixed to a floor member. The framework is movable to predetermined positions so to, in turn, position the carriage support beam in a coplanar manner with respect to loci defined by means of the wall panel or wall structure stud frame members, or along loci defined by means of abutting sheets of the wall sheathing, covering, paneling, or the like, to be fixedly secured to the underlying stud members of the wall panel framework at seam locations. As the carriage member is continuously moved along the support beam, firing of the nailing gun is initiated in an "on the fly" mode of operation. Upon completion of a particular linear array of nails into the wall sheathing, covering, paneling, or the like comprising the underlying wall panel framework, the nailing bridge is moved to the next loci so as to perform a new nailing operation. The nailing gun may also be disposed within any one of several tilt modes so as to install nails at a predetermined angle at the aforenoted seam locations.

In addition, stitcher guns are disposed upon a separate support beam for supporting nailing guns that are used to fixedly secure the sheathing, covering, paneling, or the like to the upper and lower plate, header, or footer members of the underlying wall panel or wall structure. The nailing bridge framework may include an operator platform by means of which the operator may ride along during the nailing process, and a joystick control may be mounted upon the platform so as to enable the operator to control the nailing process in a semi-automatic mode. A pair of rotary encoders are respectively operatively associated with the motor drive of the nailing bridge assembly along the floor-mounted tracks as well as being operatively associated with the motor drive for the carriage supporting the nailing gun, and all movements of the nailing guns and the framework along the tracks are known and preprogrammed into a programmable logic controller (PLC) which controls the movements of the entire nailing assembly and the firing operations of the nailing gun and movement of the assembly along the floor tracks. The stitcher guns are fired semi-automatically after being positioned by operator personnel and firing initiated through the joystick control through means of the programmable logic controller (PLC).

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
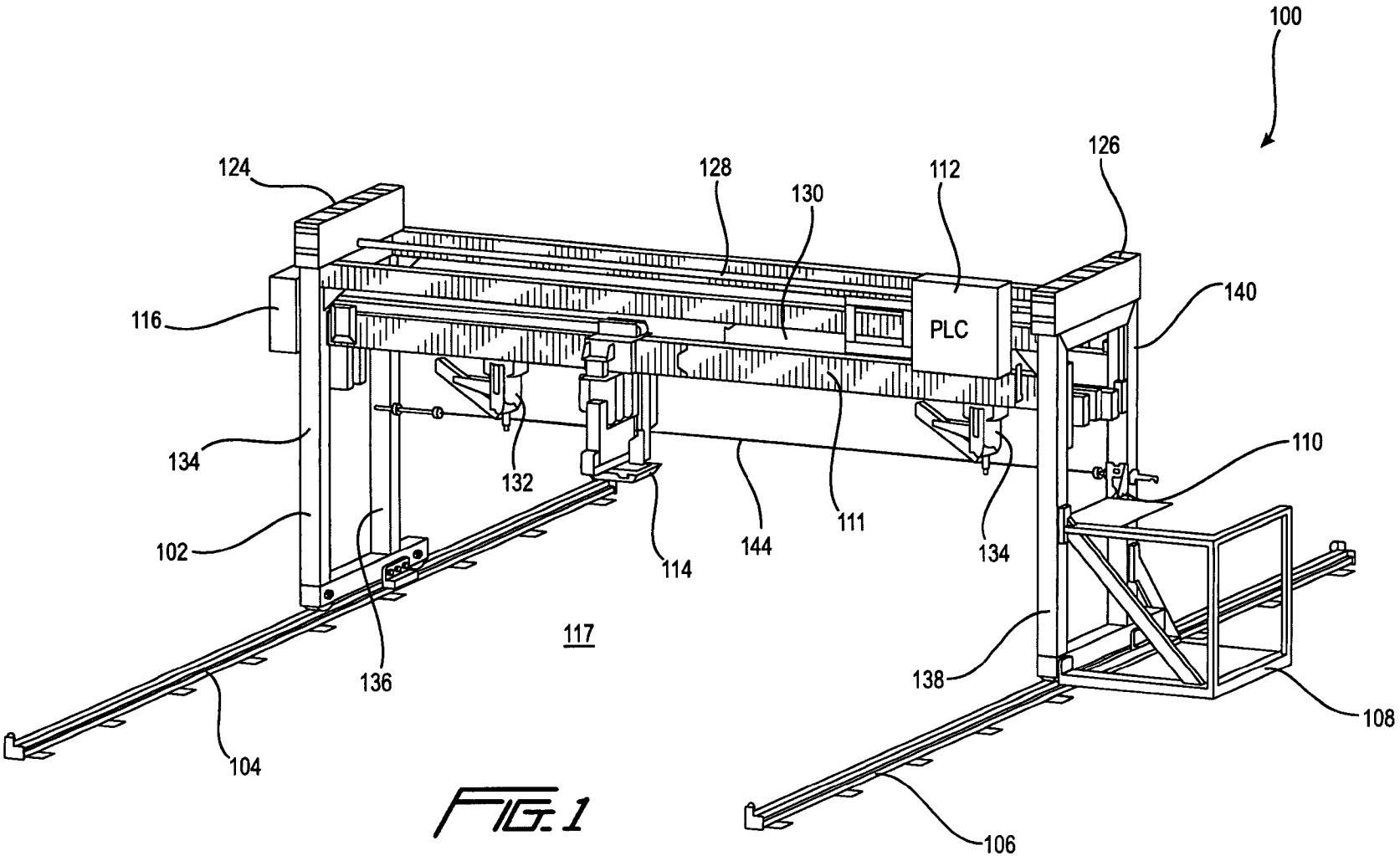
FIG. 1 is an overall perspective view of a new and improved nailing bridge system as constructed in accordance with the principles and teachings of the present invention and showing the cooperative parts thereof.

Referring now to the drawings, and more particularly to FIG. 1 thereof, a new and improved nailing bridge system is disclosed and is generally indicated by the reference character 100. More particularly, it is seen that the nailing bridge system 100 comprises a framework 102 which is movably disposed upon transversely spaced track members 104, 106. An operator platform 108 is fixedly secured to the framework 102, and an operator-controlled joystick 110 is mounted upon the operator platform 108. A first support cross-beam 111 fixedly interconnects the opposite sides of the framework 102, and as can best be seen in FIG. 2, a carriage assembly 114, which mounts a nailing gun 115, is movably supported upon the first support cross-beam 111. The operator-controlled joystick 110 is used to initiate a manual control of the carriage assembly 114 and the nailing gun 115, as well as movements of the framework 102 along the track members 104, 106, however, the joystick 108 is always operatively connected to a programmable logic controller (PLC) 112 which controls all movable components of the system 100 as will be explained more fully hereinafter.

Figure 2:
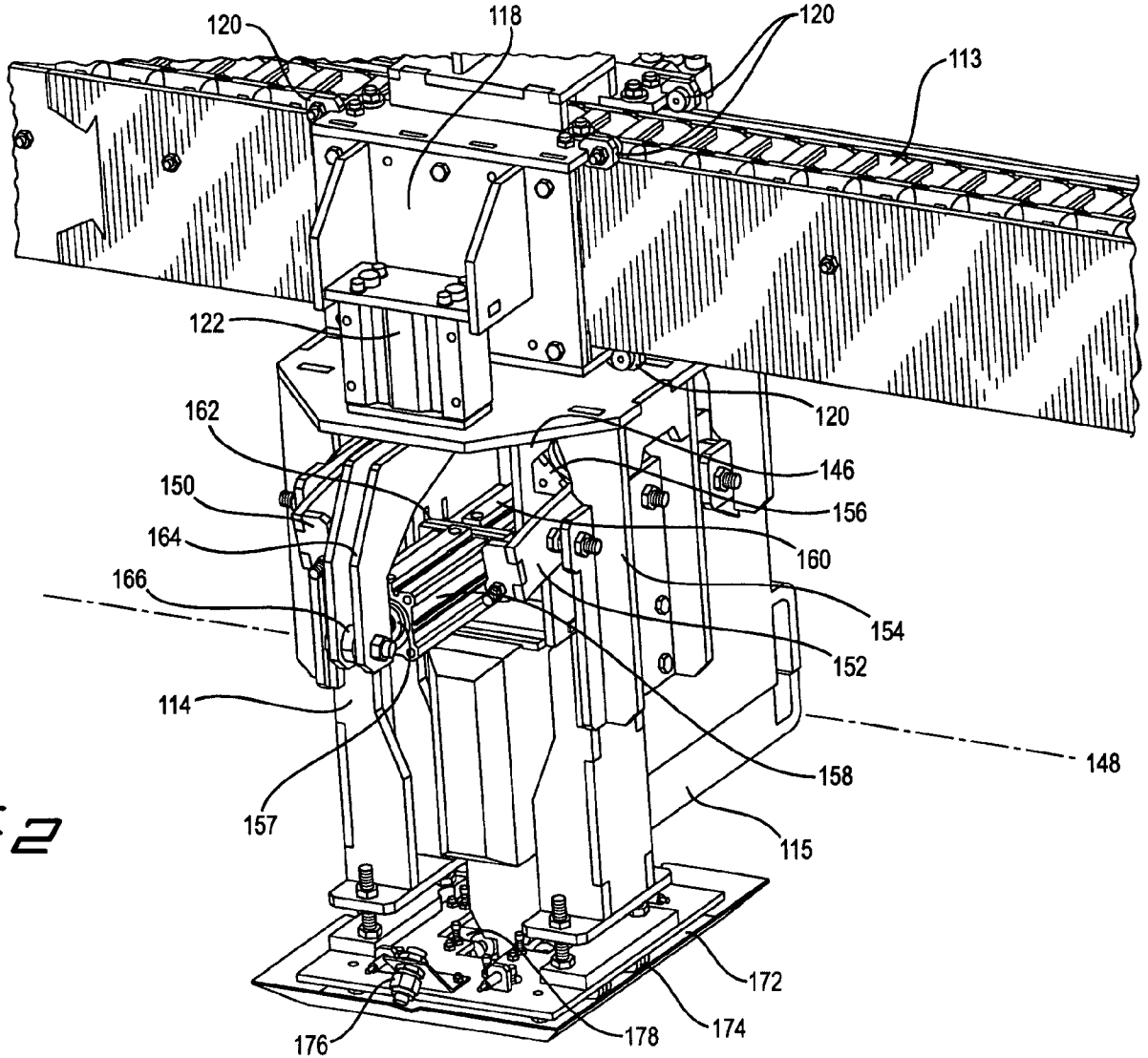
FIG. 2 is an enlarged detailed view of the nailing gun carriage mechanism as mounted upon the support beam of the nailing bridge system of FIG. 1.

A first motor-driven chain driven system, which can be seen at 113 in FIG. 2 and which includes a first rotary encoder 116, is operatively associated with the first support cross-beam 111 so as to control the position of the carriage assembly 114 and the gun 115 along the first support cross-beam 111 in order to position the nailing gun 115 at predetermined locations at which the nailing gun 115 will be fired so as to insert nails into the sheathing, covering, paneling, or the like to be secured to the plurality of 2×4 or 2×6 stud members comprising the wall panel or wall structure. The wall panel or wall structure is adapted to be disposed upon a framing table disposed at a work station 117 beneath the carriage assembly 114 and the nailing gun 115 whereby the carriage and nailing gun 115 will be accordingly lowered, for example, to a predetermined elevational level in order to in fact permit the nails to be driven into the underlying wall panel or wall structure in order to permit the sheathing, covering, paneling, or the like to be secured to the plurality of 2×4 or 2×6 stud members comprising the wall panel or wall structure. As can best be appreciated from FIG. 2, the carriage assembly 114 is actually dependently supported from a mounting block 118, which is movably disposed upon the first support cross-beam 111 by means of a plurality of rollers 120, and it is further seen that the carriage assembly 114 is also dependently supported from the mounting block 118 by means of front and rear piston-cylinder assemblies 122, only one of which is shown, wherein the piston-cylinder assemblies 122 will lower or raise the carriage assembly 114 and the nailing gun 115 mounted thereon.

Lifter mechanisms 124, 126 are provided upon opposite ends of the framework 102 and are interconnected by means a first cross-shaft 128 such that the lifter mechanisms 124, 126 will move in a coordinated matter with respect to each other. The lifter mechanisms 124, 126 are adapted to be operatively interconnected to the first support cross-beam 111 upon which the carriage assembly 114 and the nailing gun 115 are disposed, as well as to a second support cross-beam 130 upon which, for example, a pair of stitcher guns 132, 134 are disposed, as well as to the upstanding post or beam members 136, 138, 140, 142 of the frame-work 102 by means of, for example, a suitable motor drive, not shown, and suitable rack and pinion mechanisms, also not shown, so as to effectively raise or lower the first and second support cross-beams 111, 130, and the nailing gun 115 and the stitcher guns 132, 134 with respect to the underlying framework comprising the covering, sheathing, paneling, or the like to be secured to the plurality of 2×4 or 2×6 stud members and the plate, head, or footer member comprising the wall panel or wall structure. The encoder operatively associated with the motor drive for the framework 102 will feed information back to the programmable logic controller (PLC) 112 such that the programmable logic controller (PLC) 112 can, in turn, control the firing, sequencing, distancing, and the like of the firing of the stitcher guns 132, 134 as the frame-work 102 moves along the length of the underlying structure in order to secure the sheathing, drywall, paneling, and the like to the end plate, headers, footers, or the like.

The stitcher guns 132, 134 are also provided with piston-cylinder assemblies, not shown, similar to the piston-cylinder assemblies 122 for the carriage assembly 114, and the nailing gun 115, and in this manner, it can be readily appreciated that, for example, the lifter mechanisms raise and lower the first and second support cross-beams 111, 130 and the carriage 114 and nailing gun 115, as well as the stitcher guns 132, 134 in a "macro" mode of operation, while, for example, the piston cylinder assemblies 122, and the similar piston-cylinder assemblies, not shown, operatively associated with the stitcher guns 132, 134, lower or raise the carriage assembly 114 and the nailing gun 115, and the stitcher guns 132, 134 in a "micro" manner so as to dispose the nailing gun 115 and the stitcher guns 132, 134 in their proper positions with respect to the underlying framework comprising the sheathing, covering, paneling, or the like to be secured to the plurality of 2×4 or 2×6 stud members and the plate, head, or footer members comprising the wall panel or wall structure. It is also to be noted a second motor-driven, rotary encoder system, not shown, is also operatively associated with, for example, the upstanding post or beam members 136, 140, and that an interconnecting shaft 144 extends therebetween.

This second rotary encoder drive system, as well as the first rotary encoder system 116, are all operatively connected to the programmable logic controller (PLC) and serves to control the movement of the entire bridge assembly 100 and the framework 102 thereof, along the tracks 104, 106 so as to properly position the carriage assembly 114 and the nailing gun 115 with respect to the plurality of 2×4 or 2×6 stud members into which nails are to be driven so as to fixedly secure the sheathing, covering, paneling, or the like, to the underlying framework comprising the wall structure or wall panel. It may thus be readily appreciated that the operator personnel controls, through means of the joystick control 110, the position of the carriage assembly 114 and the nailing gun 115 with respect to the underlying 2×4 or 2×6 stud members, as well as the position of the framework 102 along the tracks 104, 106.

The operator personnel also, in effect, pre-programs into the programmable logic controller (PLC) 112 the particular nailing pattern, for example, the frequency at which the nailing gun 115 is fired such that nails are fired with predetermined distances therebetween, and once the operator personnel initiates a nail firing cycle by pulling a trigger switch mechanism, not shown, located upon the joystick 110, the lifter mechanisms 124, 126, for example, as well as the piston-cylinder assemblies 122 for the carriage assembly 114, and the piston-cylinder assemblies, not shown, for the stitcher guns 132, 134 will be activated so as to properly position, for example, all of the nailing and stitcher guns at their desired positions with respect to the underlying wall structure or framework. The programmable logic controller 112 will then control the movement of the carriage assembly 114 and the nailing gun 115 so as to actually initiate the firing of the various guns in accordance with data received from the pair of previously described motor drives and encoders.

The stitcher guns 132, 134 are normally located near the ends of the support beam 130 because they are only used to secure the sheathing, covering, paneling, or the like to the plate, header, or footer members of the underlying framework comprising the wall panel or wall structure. If there are differently sized wall panels or wall structures, one of the stitcher guns 134, for example, would be manually moved by operator personnel to its proper location, while the other stitcher gun 132 is substantially fixed upon its support beam 130. Once a firing operation is initiated, the programmable logic controller (PLC) 112 will continue the firing of the nails until all nails along a particular 2×4 or 2×6 stud member have been fired. At the end of the firing cycle, the programmable logic controller (PLC) 112 will activate the motor drive to raise the lifter mechanisms 124, 126 and the various piston-cylinder assemblies operatively associated with the nailing and stitcher guns 115, 132, 134, and the operator personnel then repeats the cycle by moving, for example, the framework 102 to the next 2×4 or 2×6 stud member, and pulling the switch mechanism upon the joystick 110 when the next nail firing cycle is to commence. The carriage assembly 114 and the nailing gun 115 do not have to be returned to their original positions as the nailing operation can proceed in either direction, that is, from left to right or from right to left as viewed in FIG. 1.

With particular reference now being made to FIG. 2, it has been noted that the nailing gun 115 is mounted upon the carriage assembly 114, but in actuality, the nailing gun 115 is actually mounted upon a pair of inner carriage frame assembly 146, only one of which is visible in FIG. 2, wherein the nailing gun 115 is actually pivotal or tiltable about a transverse axis 148 such that a forward portion of nailing gun 115 can be disposed in a normally centered angular position at which the nailing gun 115 is firing vertically straight downwardly, a positively tilted position at which the nailing gun 115 is tilted, in effect, with its nose portion directed slightly rearwardly so as to insert a nail at a predetermined positive angle before a seam of, for example, which a pair of sheets of plywood, drywall, or the like, are to be secured to a particular 2×4 or 2×6 stud member, and a negatively tilted position at which the nailing gun is tilted, in effect, with its nose portion directed slightly forwardly so as to insert a nail at a predetermined negative or positive angle after a seam of, for example, a pair of sheets of plywood, drywall, or the like, which are to be secured to a particular 2×4 or 2×6 stud member so as to enhance pull-out resistance and provide for the proper insertion of the nails into the 2×4 or 2×6 stud members.

Figure 3B:
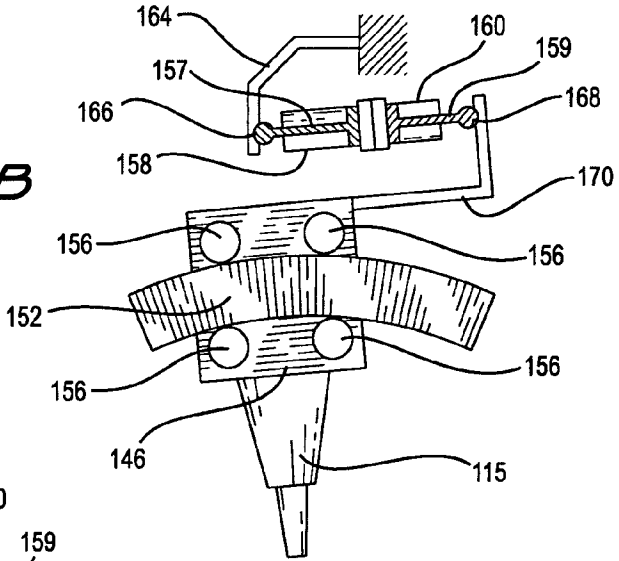
FIG. 3B is a schematic drawing illustrating the operative interconnections between the dual piston-cylinder assemblies and the inner carriage frame assembly in order to effectively ensure that the nailing gun will be discharging its nails in a positively tilted mode along a seam of plywood, drywall, or other abutting sheathing members.
Figure 3C:
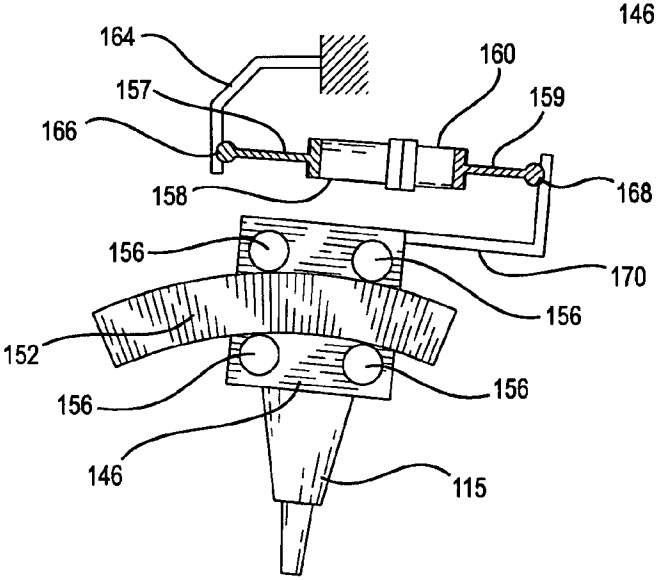
FIG. 3C is a schematic drawing illustrating the operative interconnections between the dual piston-cylinder assemblies and the inner carriage frame assembly in order to effectively ensure that the nailing gun will be discharging its nails in a negatively tilted mode along a seam of plywood, drywall, or other abutting sheathing members.
Figure 3A:
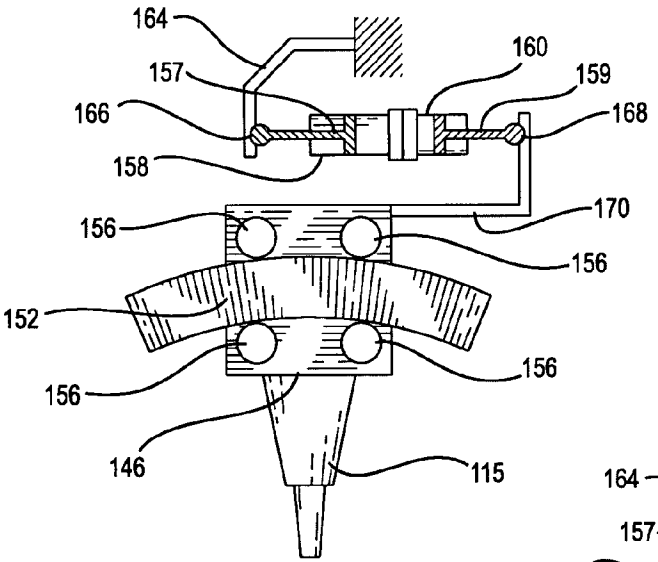
FIG. 3A is a schematic drawing illustrating the operative interconnections between the dual piston-cylinder assemblies and the inner carriage frame assembly in order to effectively ensure that the nailing gun will be discharging its nails vertically downwardly.

A pair of arcuate tracks 150, 152 are bolted to an outer carriage frame assembly 154, and a plurality of roller mechanisms, four for engaging each one of the arcuate tracks 150, 152 but only one of which is visible at 156 in FIG. 2, although all four of one set are disclosed within FIGS. 3A-3C, are mounted upon, for example, the inner carriage frame assembly 146 and also ride upon the arcuate tracks 150, 152 so as to permit the pivotal movement of the nailing gun 115 to occur as a result of the rolling movement of the rollers 156 along the arcuate tracks 150, 152. More particularly, in order to in fact achieve the aforenoted different firing modes of the nailing gun 115, it is further seen that a pair of forward and rearward piston-cylinder assemblies 158, 160 are disposed in a back-to-back position and are bolted together by means of a pair of transversely oriented mounting plates 162. Since the piston-cylinder assemblies 158, 160 are disposed in their back-to-back fashion, it is to be appreciated that the piston rods 157, 159 of each piston-cylinder assembly 158, 160 are disposed in opposite directions with respect to each other. For example, a gooseneck-shaped clevis-type mounting bracket 164 is integral with and projects downwardly from the outer carriage assembly 154, and it is seen that a forwardmost portion 166 of the piston rod 157 of the forward piston-cylinder assembly 158 is fixedly bolted between the end portions of the gooseneck-shaped clevis type mounting bracket 164. Conversely, the rearwardmost portion 168 of the piston rod 159 of the rearward piston-cylinder assembly 160 is operatively connected to and interposed between a pair of linkage members 170, only one of which is shown in FIGS. 3A-3C, so as to be respectively connected to the inner carriage frame assembly 146.

Accordingly, it can be readily appreciated that when, for example, the rearward piston rod 159 of the rearward piston-cylinder assembly 160 is disposed in its extended position while the piston rod 157 of the forward piston-cylinder assembly 158 is disposed in its retracted position, as illustrated in FIG. 3A, the nailing gun 115 will be disposed at its normally centered or neutral angular position so as to achieve straight down or vertically oriented nailing operations. However, when the rearward piston rod 159 of the rearward piston-cylinder assembly 160 is disposed in its retracted position while the piston rod 157 of the forward piston-cylinder assembly 158 is maintained at its retracted position, as illustrated in FIG. 3B, the linkage member 170 will cause the inner carriage frame assembly 146 to effectively move forwardly thereby causing the nailing gun 115 to be disposed at a positive angle so as to be capable of inserting nails into the underlying framework at a predetermined angle before a seam defined, for example, by means of a pair of plywood, drywall panels, and the like, to be fixedly secured to a particular one of the 2×4 or 2×6 stud members.

Conversely, still further, when the rearward piston rod 159 of the rearward piston-cylinder assembly 160 is once again extended, as illustrated in FIG. 3C, the inner carriage frame assembly 146 will once again effectively achieve its neutral position as illustrated within FIG. 3A, however, when the forward piston rod 157 of the forward piston-cylinder assembly 158 is now also extended, since the forward piston-cylinder assembly 158 acts directly upon the rearward piston-cylinder assembly 160, the extension of the forward piston rod 157 of the forward piston-cylinder assembly 158 will effectively cause the entire piston-cylinder assemblies 158, 160 and the linkage member 170 to move rearwardly whereby the inner carriage frame assemblies 146 will effectively move rearwardly thereby causing the nailing gun 115 to be disposed at a negative angle so as to be capable of inserting nails into the underlying framework at a predetermined angle after the seam defined, for example, by means of a pair of plywood, drywall panels, and the like, to be fixedly secured to a particular one of the 2×4 or 2×6 stud members.

Lastly, reverting back again to FIG. 2, a guard assembly 172 is fixedly mounted upon the lower end portion of the carriage assembly 114 in order to effectively guide the same along the upper surface portion of the wall structure or wall panel being fabricated, and it is seen that a plurality of rollers 174 are mounted upon the guard assembly 172 so as to effectively project downwardly through the same and engage the upper surface portion of, for example, the plywood, drywall, or the like being secured to the underlying framework comprising the plate, header, or footer members and the 2×4 or 2×6 stud members in order to, in effect, guide the carriage assembly therealong. In addition, a laser beam 176 member is also attached to the front end portion of the carriage assembly 114, or more particularly to the guard assembly 172 thereof, in order to provide the operator the precise location of the centerline axis of the nailing gun 115 which enables him, for example, to precisely locate the gun through means of his joystick control 110 whereby such signals can be routed through the programmable logic controller (PLC) 112 so as to determine, for example, how far apart the nails should be spaced when actually fired into the underlying framework. In this manner, it can be readily appreciated that when a nail firing operation is to be commenced such that the underlying framework, comprising the plate, header, or footer members, the 2×4 or 2×6 stud members which are oriented perpendicular to the tracks 104, 106, and the sheathing, plywood, drywall, or the like, which is to be disposed atop the plate, header, or footer members, the 2×4 or 2×6 stud members, are disposed at the work station 117 whereby the framework can be fabricated, the entire framework 102 is then disposed at, for example, the rear end of the tracks 104, 106, and the stitcher guns 132, 134 are manually positioned so as to be capable of driving nails into the sheathing, plywood, or drywall, to be affixed to the underlying framework comprising the plate, header, or footer members. Along these lines, an edge detection switch mechanism 178 is also provided upon the guard assembly 172 so as to detect approaching wall or window edges and thereby transmit suitable signals back to the programmable logic controller (PLC) 132 in order not to fire any nails within this region or vicinity.

In addition, the lifter mechanisms 124, 126 will be actuated or lowered so as to effectively bring the carriage assembly 114 and the nailing gun 115 into approximate contact with upper surface of the underlying framework to be fabricated, and subsequently, the piston-cylinder assemblies 122 can be activated so as to effectively locate the nailing gun 115 at the precise height above the underlying framework. The motor drive and encoder 116 may then be activated by means of the operator and his joystick control 110 and signals from the encoder will be transmitted to the programmable logic controller (PLC) 112, and the carriage assembly 114 is moved along the support beam 111 so as to position the carriage assembly 114 and the nailing gun 115 at predetermined positions along the support beam 111 at which nails are to be fired downwardly into the sheathing, plywood, drywall, or the like so as to fixedly secure the same to the underlying 2×4 or 2×6 stud members. The programmable logic controller (PLC) 112 has, of course, the particular nailing layout of the underlying framework preprogrammed into its memory, in other words, how often the nailing gun 115 should be fired so as to effectively insert a predetermined number of nails into the underlying 2×4 or 2×6 studs at predetermined distances apart. The rotary encoder of course begins counting as soon as the associated motor drive is initiated, ad it feeds appropriate signals back to the programmable logic controller (PLC) 112 which controls the movement of, for example, the carriage assembly 114 and the nailing gun 115 and the frequency or locations at which the nailing gun 115 is actually fired.

When the carriage assembly 114 and the nailing gun 115 have traversed an entire 2×4 or 2×6 stud member so as to have inserted the desired number of nails thereinto, the lifter mechanisms 124, 126, as well as the piston-cylinder assemblies 122, may be elevated or retracted so as to remove the carriage assembly 114 and the nailing gun 115 from within the vicinity of the underlying framework being fabricated. The second motor-driven, rotary encoder system, not shown, operatively associated with, for example, the upstanding post or beam members 136, 140, and the interconnecting shaft 144 which extends therebetween, may now be activated by the joystick control 110 of the operator personnel so as to effectively move the entire framework a predetermined distance along the tracks 104, 106, under the control, of course of the programmable logic controller (PLC) 112, such that the support beam 111, the carriage assembly 114, and the nailing gun 115 are now disposed above the next 2×4 or 2×6 stud member into which additional nails are to be inserted in order to secure the remaining portions of the sheathing, drywall, plywood, or the like whereby, of course, a new or additional nailing operation may be implemented. It is of course to be appreciated that if sections of the drywall, sheathing, or plywood abut together atop a particular 2×4 or 2×6 stud member, then the aforenoted tilting actions of the nailing gun 115 me be implemented in order to achieve such fixation of the sheathing, drywall, plywood, or the like to the underlying 2×4 or 2×6 stud members in order to enhance pull-out resistance and the proper insertion of the nails into the 2×4 or 2×6 stud members. As has also been noted, the programmable logic controller (PPLC) 112 will initiate movement of the carriage assembly 114 and the nailing gun 115 so as to in fact position the nailing gun 115 at the predetermined locations at which the nails are to be driven into the underlying framework. It is again noted that the carriage assembly 114 and the nailing gun 115 do not have to be returned to their original positions as the nailing operation can proceed in either direction, that is, from left to right or from right to left, as viewed in FIG. 1.

Thus, it may be seen that in accordance with the principles and teachings of the present invention, there has been provided a new and improved nailing bridge system which comprises a nailing gun which is mounted for movement along a stud frame locus or a seam locus, defined by means of abutting sheets of wall sheathing, covering, paneling, or the like, wherein the nailing gun can be moved to any one of effectively an infinite number of positions so as to permit nails to be driven into the covering, sheathing, paneling, or the like, in order to fixedly secure the sheathing, covering, paneling, or the like, to underlying stud frame members of a wall structure or wall panel member. Stitcher guns are also mounted upon a separate support beam so as to fixedly secure the sheathing, covering, paneling, or the like, to the upper and lower plate, header, or footer members of the wall structure or wall panel member. The nailing gun may also be tilted for attaching sheathing, plywood, drywall, and the like to a single 2×4 or 2×6 at which the sheathing, plywood, drywall, and the like will abut each other, and all movements of the nailing gun carriage along its particular support beam, as well as movements of the entire framework upon which the carriage assembly and the nailing gun, as well as the stitcher guns are mounted, and the firing of the nailing gun, are controlled by a programmable logic controller (PL C).

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A nailing bridge system for mounting a nail gun, comprising:

a longitudinally extending support surface;

a pair of transversely spaced tracks extending along said longitudinally extending support surface;

first and second framework members, respectively disposed upon said pair of transversely spaced tracks for longitudinal movement along said pair of transversely spaced tracks, and comprising a first support beam which extends transversely between said first and second framework members and is disposed above an underlying structure into which nails are to be driven in order to secure articles to the underlying structure;

a carriage assembly movably mounted upon said first support beam for movement along said first support beam in a transverse direction so as to be disposed at any one of a plurality of positions along a transverse locus along which nails are to be driven into the underlying structure;

a nailing gun mounted upon said carriage assembly for inserting nails into the underlying structure as said carriage assembly is moved along said first support beam in said transverse direction;

wherein said nailing gun is pivotally mounted upon said carriage assembly within a longitudinally extending plane and around a transversely oriented pivotal axis which is disposed parallel to said first transversely extending support beam such that said nailing gun can achieve various different firing modes with respect to the underlying structure;

said nailing gun is pivotally mounted upon an inner carriage frame assembly;

a pair of arcuate-shaped mounting brackets are fixedly mounted upon an outer carriage frame assembly;

a plurality of roller mechanisms interconnect said inner carriage frame assembly to said pair of arcuate-shaped mounting brackets; and a pair of piston-cylinder assemblies, comprising first and second piston rods, interconnect said outer carriage frame assembly to said inner carriage frame assembly so as to cause said inner carriage frame assembly, and said nailing gun, to be movable with respect to said outer carriage frame assembly.

2. The nailing bridge system as set forth in claim 1, further comprising:

lifter mechanisms for raising and lowering said first support beam, said carriage assembly disposed thereon, and said nailing gun mounted upon said carriage assembly so as to adjust the disposition of said nailing gun with respect to the underlying structure.

3. The nailing bridge system as set forth in claim 2, further comprising:

a first rotary encoder/motor drive system operatively associated with the movement of said carriage assembly along said first support beam; and a second rotary encoder/motor drive system operatively associated with the movement of said framework along said pair of tracks.

4. The nailing bridge system as set forth in claim 3, further comprising:

a second support beam extending transversely between said first and second framework members and disposed above the underlying structure into which nails are to be driven in order to secure articles to the underlying structure; and a pair of stitcher guns mounted upon said second support beam.

5. The nailing bridge system as set forth in claim 4, further comprising:

lifter mechanisms for raising and lowering said first and second support beams, said carriage assembly disposed upon said first support beam, said nailing gun mounted upon said carriage assembly so as to adjust the disposition of said nailing gun with respect to said underlying structure, and said stitcher guns mounted upon said second support beam so as to adjust the disposition of said stitcher guns with respect to the underlying structure.

6. The nailing bridge system as set forth in claim 5, wherein:

said first rotary encoder/motor drive system, said second rotary encoder/motor drive system, and said lifter mechanisms are operatively controlled by means of a programmable logic controller (PLC).

7. The nailing bridge system as set forth in claim 5, wherein:

first structure is provided for facilitating the movement of said carriage assembly along said first support beam.

8. The nailing bridge system as set forth in claim 7, wherein:

said first structure for facilitating the movement of said carriage assembly along said first framework support beam comprises a plurality of rollers.

9. The nailing bridge system as set forth in claim 5, wherein:

second structure is provided for movably mounting said carriage assembly with respect to said first support beam and toward and away from the underlying structure.

10. The nailing bridge system as set forth in claim 9, wherein:

said second structure for movably mounting said carriage assembly with respect to said first support beam toward and away from the underlying structure comprises a piston-cylinder assembly.

11. The nailing bridge system as set forth in claim 1, wherein:

said pair of piston-cylinder assemblies are disposed in a back-to-back mode wherein said first and second piston rods thereof extend in opposite directions.

12. The nailing bridge system as set forth in claim 11, wherein:

when a first one of said pair of piston-cylinder assemblies, comprising said first piston rod, has said first piston rod disposed in a retracted position, and wherein the second one of said pair of piston-cylinder assemblies, comprising said second piston rod, has said second piston rod disposed in an extended position, said nailing gun is disposed at a neutral position at which said nailing gun discharges nails vertically downwardly.

13. The nailing bridge system as set forth in claim 12, wherein:

when a first one of said pair of piston-cylinder assemblies, comprising said first piston rod, has said first piston rod disposed in a retracted position, and wherein the second one of said pair of piston-cylinder assemblies, comprising said second piston rod, has said second piston rod disposed in a retracted position, said nailing gun is disposed at a positive angular position with respect to a vertical plane at which said nailing gun discharges nails rearwardly so as to enhance pull-out resistance.

14. The nailing bridge system as set forth in claim 12, wherein:

when a first one of said pair of piston-cylinder assemblies, comprising said first piston rod, has said first piston rod disposed in an extended position, and wherein the second one of said pair of piston-cylinder assemblies, comprising said second piston rod, has said second piston rod disposed in an extended position, said nailing gun is disposed at a negative angular position with respect to a vertical plane at which said nailing gun discharges nails forwardly so as to enhance pull-out resistance.

15. The nailing bridge system as set forth in claim 1, further comprising:

an operator platform fixedly secured to one of said first and second framework members for movement with said first and second framework members along said pair of transversely spaced tracks.

16. The nailing bridge system as set forth in claim 15, further comprising:

an operator-controlled joystick mounted upon said operator platform for controlling the movements of said first and second framework members along said pair of transversely spaced tracks as well as the movements of said carriage assembly along said first support beam.

17. The nailing bridge system as set forth in claim 15, further comprising:

an edge detection switch mechanism mounted upon said guard assembly of said carriage assembly for determining boundary limitation regions of the underlying structure into which nails are not to be driven.

18. The nailing bridge system as set forth in claim 1, further comprising:

a guard assembly fixedly mounted upon a lower end portion of said carriage assembly in order to effectively guide the movement of said carriage assembly along the underlying structure into which nails are to be driven.

19. The nailing bridge system as set forth in claim 18, further comprising:

a laser beam member mounted upon said guard assembly of said carriage assembly so as to precisely locate the particular positions at which the nails are to be driven into the underlying structure.

* * * * *